US006070818A

United States Patent [19]

Taylor

[11] Patent Number: 6,070,818

[45] Date of Patent: Jun. 6, 2000

[54] MINERAL CRUSHER HAVING A RETRACTABLE COLLECTION MEMBER

[75] Inventor: Robert Taylor, Sheffield, United Kingdom

[73] Assignee: Taylor Woolhouse Limited, Rotherham, United Kingdom

[21] Appl. No.: 09/171,540

[22] PCT Filed: Apr. 18, 1997

[86] PCT No.: PCT/GB97/01079

§ 371 Date: May 12, 1999

§ 102(e) Date: May 12, 1999

[87] PCT Pub. No.: WO97/39828

PCT Pub. Date: Oct. 30, 1997

[51] Int. Cl.[7] ..... B02C 13/282

[52] U.S. Cl. ..... 241/189.1; 241/275; 241/289; 241/290

[58] Field of Search ..... 241/275, 285.3, 241/288, 289, 290, 189.1

[56] References Cited

U.S. PATENT DOCUMENTS 2,292,852 8/1942 Werner .

FOREIGN PATENT DOCUMENTS

| | | |
|---|---|---|
| 2323444 | 4/1977 | France . |
| 967697 | 12/1957 | Germany . |
| 04235753 | 8/1992 | Japan . |
| 05131155 | 5/1993 | Japan . |
| 360871 | 4/1962 | Switzerland . |
| 633102 | 12/1949 | United Kingdom . |

*Primary Examiner*—Mark Rosenbaum
*Attorney, Agent, or Firm*—Baker Botts, L.L.P.

[57] ABSTRACT

A mineral crusher comprises a roller 50 having a plurality of impeller bars for impelling mineral material against a collection plate 100, upon which a collection of mineral material accumulates. The material thrown against the accumulated material is reduced by impact with the accumulated material. The collection plate is adjustable, so as to adjust the size of mineral accumulation, and is tiltable so as to spring away from the roller when oversize objects, eg pieces of metal or blocks of wood pass through the crusher. The arrangement may have an advantage of incurring reduced wear on the collection plate 100, which may require less frequent replacement. The collection plate 100 is relatively easy to manufacture.

7 Claims, 6 Drawing Sheets

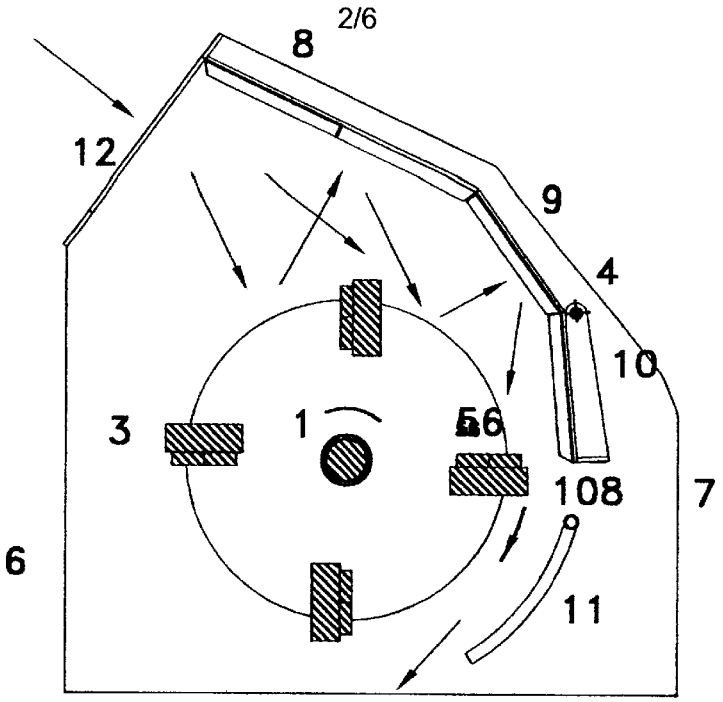
FIG. 2 PRIOR ART
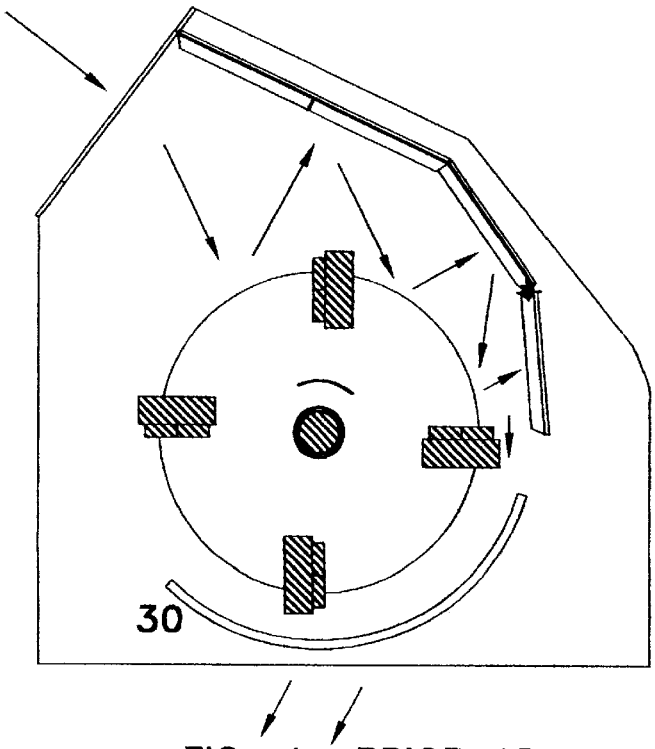
FIG. 4 PRIOR AR

MINERAL CRUSHER HAVING A RETRACTABLE COLLECTION MEMBER

TECHNICAL FIELD

The present invention relates to a mineral crusher for reducing a mineral material, comprising a rotating roller having a plurality of projecting impact members.

BACKGROUND ART

In a known mineral breaker of the type for reducing rock, coal, rubble or the like, a rotating drum has a plurality of blow bars, impact bars or teeth, which as the roller rotates at high speed, impact large lumps and particles of the mineral causing reduction in mineral particle size. In some cases, the blow bars throw the mineral against a breaker plate, spaced apart from the roller. Reduction of the mineral material occurs by impact with the blow bars, impellers or teeth and by impact with the breaker plate.

Referring to FIGS. 1 and 2 of the accompanying drawings, there is shown a prior art mineral crusher assembly comprising a roller 1 arranged to rotate under power about an axle 2, the roller comprising a plurality of impeller bars 3 extending radially outward of the roller, an outer casing 4 comprising first and second opposite upright sides, a front panel 6, a back panel 7 and a roof, the roof being lined with a plurality of breaker plates 8, 9, 10 against which the mineral is thrown, and a grid 11.

On entering an open mouth 12 of the crusher, the mineral encounters the rapidly rotating roller 1 and is reduced by impact with the roller, and particularly the impeller bars 3. The impeller bars throw lumps of the material against the breaker plates 8, 9, 10 and the mineral repeatedly bounces backwards and forwards between the roller and the breaker plates, being reduced on every impact.

On reaching the rear of the crusher, the mineral drops down under gravity, and under force imparted by the rotating roller, onto the grid 11. The reduced mineral drops out from underneath the crusher into a hopper, conveyor belt or the like.

The maximum size of particle to which the mineral is reduced is largely determined by the distance between the final breaker plate 10 and the roller. The position of the final breaker plate 10 with respect to the roller is adjustable.

The resulting reduced mineral has a range of particle sizes varying from various small particles eg. grains of sand, through aggregate of 10 mm, 20 mm average particle size, up to the maximum particle size, eg. 100 mm. The reduced mineral may be separated and graded into different sized particles as required on exiting the crusher.

Final reduction of the mineral occurs at the grid 11 in the prior art crusher of FIG. 2. The grid 11 comprises a plurality of substantially parallel bars spaced apart from each other. The position of the grid with respect to the roller may be adjustable, and the grid may be swung away from the roller, being swung from a hinge.

The grid 11 is shown schematically in FIG. 3 herewith.

Another prior art crusher, shown in FIG. 4 herewith, operates similarly as the crusher of FIG. 2, except that the final reduction occurs by the hinged grid section 30 completely underneath the roller, between the front and rear panels of the casing.

However, there are problems with the prior art crushers where a non reducible item, eg. a piece of steel bar, or a large block of wood, is entered into the mouth of the crusher. The over size object may become lodged between the breaker plate and the roller, causing damage to the breaker plate, or causing the roller to stop rotating, with possible damage to the drive mechanism to the roller as well as to the breaker.

Further, the grid 11 and the semi circular grid 30 each experience a high degree of wear, leading to increased maintenance and running costs of the crusher.

Mineral crushers are disclosed in patent abstracts of Japan, volume 017, number 496 (C-1108), 8.09.1993 and JP 05131155A (Kurimoto Limited), 28.05.1993 and volume 016, number 584 (C1013), 24.12.1992 and JP 04235753A (Kurimoto Limited), 24.02.1992. However, the crushers disclosed in these documents appear to incorporate relatively complicated adjustment apparatus in order to move a breaker plate and a collection member. Also the collection member appears to be rather small and particles resulting from crushing minerals entered into the crusher may not necessarily all accumulate within it.

In GB-A-633102 (Pattinson) a crushing machine which utilizes material which has already been crushed in an attempt to aid crushing of new material and prevent undue wear on the striking surfaces of the crushing machine is disclosed. However, the machine does not appear to have any provisions should an oversized piece of material be entered into it, thereby risking damage to the machine. In FR-A-2323444 (Hazemag) apparatus is disclosed having a breaker which may be adjustable. However, the crusher does not appear to be capable of varying the amount of ground mineral accumulated.

DISCLOSURE OF THE INVENTION

According to one aspect of the present invention there is a provided a mineral crusher for reducing a mineral material, the crusher comprising:

A rotating roller having a plurality of projecting impact members;

a collection member for retaining an accumulation of mineral material, wherein the arrangement is such that in use, the said impact members act to throw the mineral material towards the collection member; and a casing base having an upright wall into which said collection member is removeably fitted;

characterized by said collection member being retractable and extendible into said upright wall.

Preferably, said collection member is tiltable against resilience of at least one compression spring.

Preferably, said tiltable collection member is tiltable about a substantially horizontal position.

Preferably, said tiltable collection member allows passage of oversized material passed said collection member.

Preferably, said collection member is slideable in a substantially horizontal direction either towards or away from said roller. Such that a surface area of said collection member extendible from said casing is adjustable.

Preferably, said collection member is arranged to accumulate said mineral material such that said accumulation reduces said thrown material upon impact of said thrown material and said accumulated material.

Preferably, an area of said upper surface of said collection member which is exposed to said thrown material is adjustable such as to allow the volume of accumulated material to be varied.

Preferably, by adjustment of the surface area of the collection member exposed to said thrown material, a surface area of the accumulation of material exposed to the thrown material can be varied.

Preferably, said mineral material is thrown directly by the impact members in a downward direction at said accumulation of mineral material. Preferably, wherein in use, the said accumulation of material forms an inclined face presented opposite the said roller.

Preferably, said collection member is arranged at a position below a main rotational axis of the roller.

Preferably, said collection member extends in a plane transverse to a tangent of a direction of rotation of said impact members.

Preferably, said collection member extends in a plane substantially parallel to a plane passing through a main rotational axis of the roller.

Preferably, a mineral passage exists between an upright wall of the casing and a roller through which mineral passes in use, wherein said collection member is positioned to intercept material passing through said passage.

Preferably, said collection member is positioned below a substantially upright breaker plate, the arrangement being such that the accumulation of material forms between the upright breaker and the collection member.

Preferably, the mineral crusher further comprises an adjustable breaker plate positioned above said collection member.

Preferably, the mineral crusher further comprises an adjustable breaker plate arranged opposite said roller, and capable of adjustment either towards or away from said roller.

Preferably, said breaker plate is capable of adopting an operating position in which the breaker plate is maintained relatively rigidly under the impact of mineral material against the breaker plate, and is capable of adopting a release position, said release position being further away from the roller than said operating positions.

Preferably, said adjustable breaker plate is resiliently biased towards the operating position. Preferably, said breaker plate is arranged to pivot about an upper end thereof.

Preferably, a gap between the breaker plate and roller may be varied for producing a selected size of miner particles.

Preferably, said collection member comprises a plate of hardened steel.

BRIEF DESCRIPTIONS OF THE DRAWINGS

For a better understanding of the invention, and to show how embodiments of the same may be carried into effect, reference will now be made, by way of example, to the accompanying diagrammatic drawings, in which:

FIGS. 1 and 2 schematically illustrate a known mineral crusher assembly;

FIG. 3 schematically illustrates the grid of the known mineral crusher in FIG. 2;

FIG. 4 schematically illustrates a second known mineral crusher;

DETAILED DESCRIPTION OF THE BEST MODE FOR CARRYING OUT THE INVENTION

Figure 1:
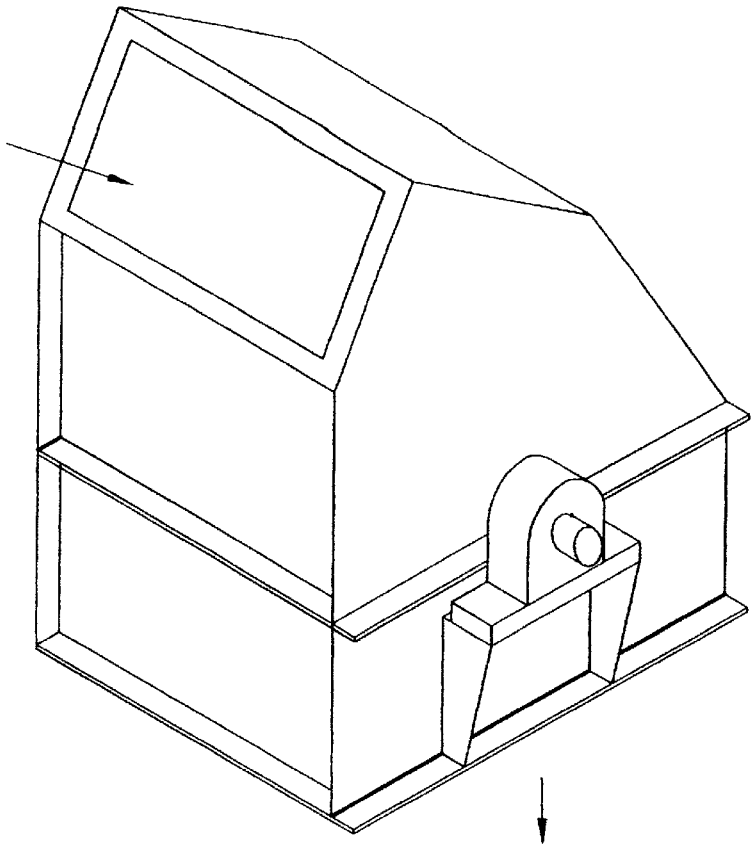
FIG.1 PRIOR ART
Figure 3:
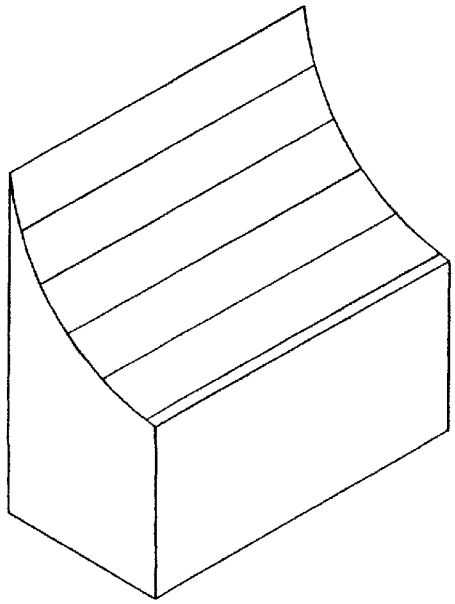
FIG. 3 PRIOR ART
Figure 5:
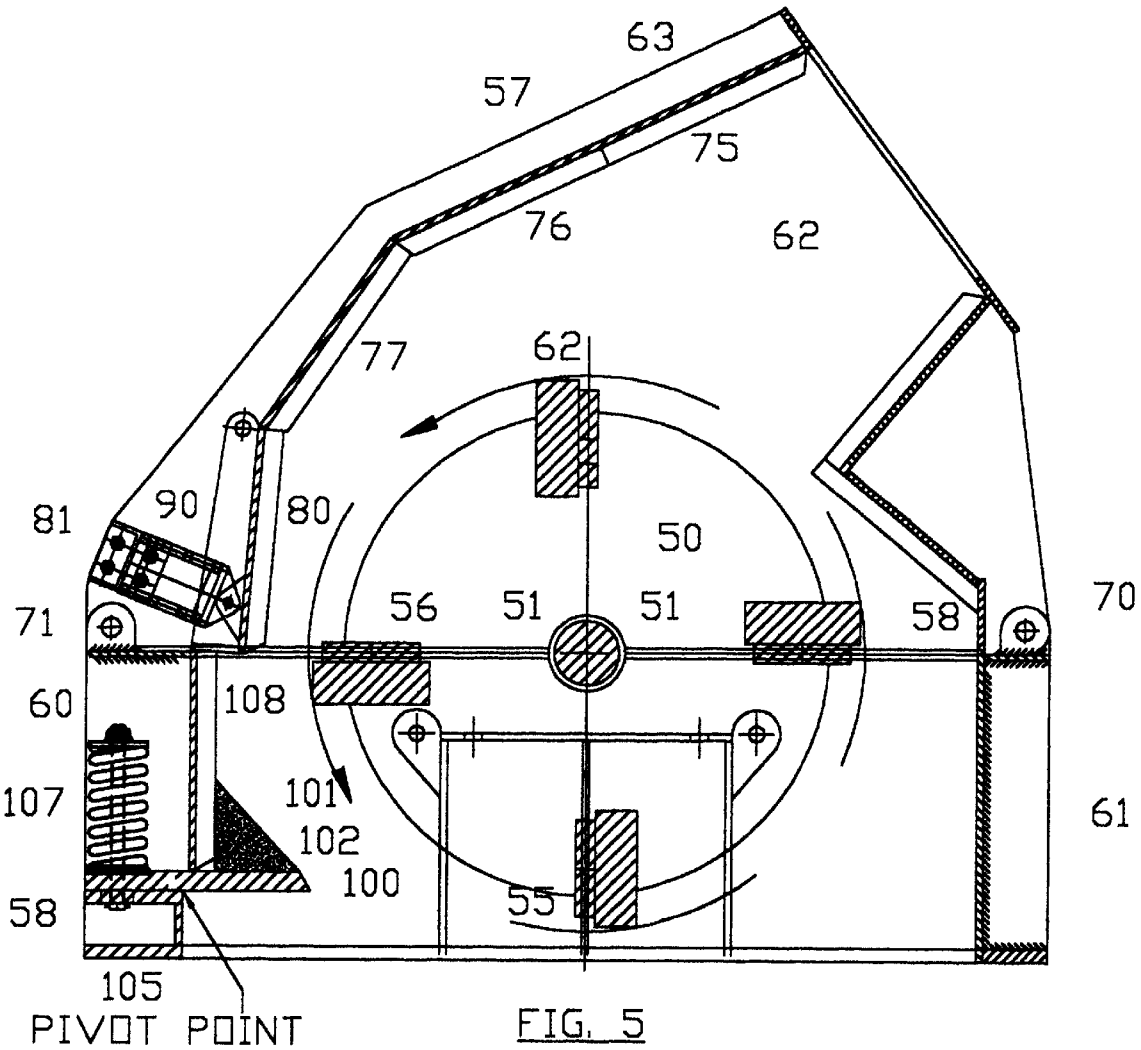
FIG. 5 shows in side elevation a mineral crusher according to a first preferred embodiment of the present invention having an extended collection member.

Referring to FIG. 5 of the accompanying drawings, a mineral crusher comprises a roller 50 arranged to rotate about a main central axis 51, by means of a central axle 52, which may be driven externally of the crusher, the roller comprising a plurality of impact members 53, 54, 55, 56 extending substantially radially from the roller; a casing 57, comprising a base portion 58 and a canopy portion 59, the base portion 58 comprising first and second base sides, one positioned each side of the roller, and front and end base plates 60, 61, respectively, and the canopy 59 comprising first and second canopy sides, positioned either side of the roller, between the canopy sides a mouth portion 62, for entering mineral into the canopy, and a sloping roof portion 63, 64. The canopy 59 is hingedly connected to the base 58 by means of removable hinges 70, 71 provided at the front and rear of the casing respectively, so that the canopy can tilt either backwards or forwards, for maintenance and for clearance of debris etc. The interior of the canopy is lined with a plurality of thick steel plates 75, 76, 77, against which mineral may be impacted. At a rear end of the roof 59 is provided an adjustable breaker plate 80, which may be arranged in an upright position or vertically. The breaker plate is adjustable, such that a gap between the breaker plate 80 and the roller 50 may be varied for producing a selected size of mineral particles. The adjustable breaker plate 80 is resiliently biased by a resilient means 90, in the form of one or a plurality of coil springs, such as to allow the adjustable breaker plate 80 to be swung away from the roller under the force of an over size article, eg. steel object such as steel bar or girder, or a large block of wood. The adjustable breaker plate 80 provided with adjustment means secured to a reverse side of the breaker plate and to a breaker plate support 81 comprising the canopy 59. The adjustable breaker plate is capable of adopting a normal operating position, in which the breaker plate does not move under the forces of normal impact of mineral material there against, or adopting a release position, in which the adjustable breaker plate is capable of pivoting about a pivot axis at an upper end of the breaker plate, so as to move further away from the roller.

At the rear of the base, is provided a collection member 100, in the form of a thick hardened steel plate which projects into a passage 101 between the rear end of the base of the casing and the roller 50. The collection member can be slid in a substantially horizontal direction either towards or away from the roller, such that a surface area of the collection member which is exposed in the passage 101 can be increased or reduced. The plane of the surface of the collection member exposed in the passage is presented transverse to a tangent to the direction of rotation of the roller.

The collection member is secured to a collection member base 105 in the form of a box section steel fabrication, and a front end of the collection member projects over one end of the collection member base. The rear end of the collection member is secured to the collection member base by elongate bolts or other means, and compression springs 107, with the effect that the rear end of the collection member is urged downwards onto the collection member base. When the forward end of the collection member is depressed with sufficient force, the collection member is tiltable, against the resilience of the compression springs 107, the collection member immediately returning to the substantially horizontal position upon release of the downward force on the front of the collection member, by virtue of the resilience of the compression springs 107.

Figure 6:
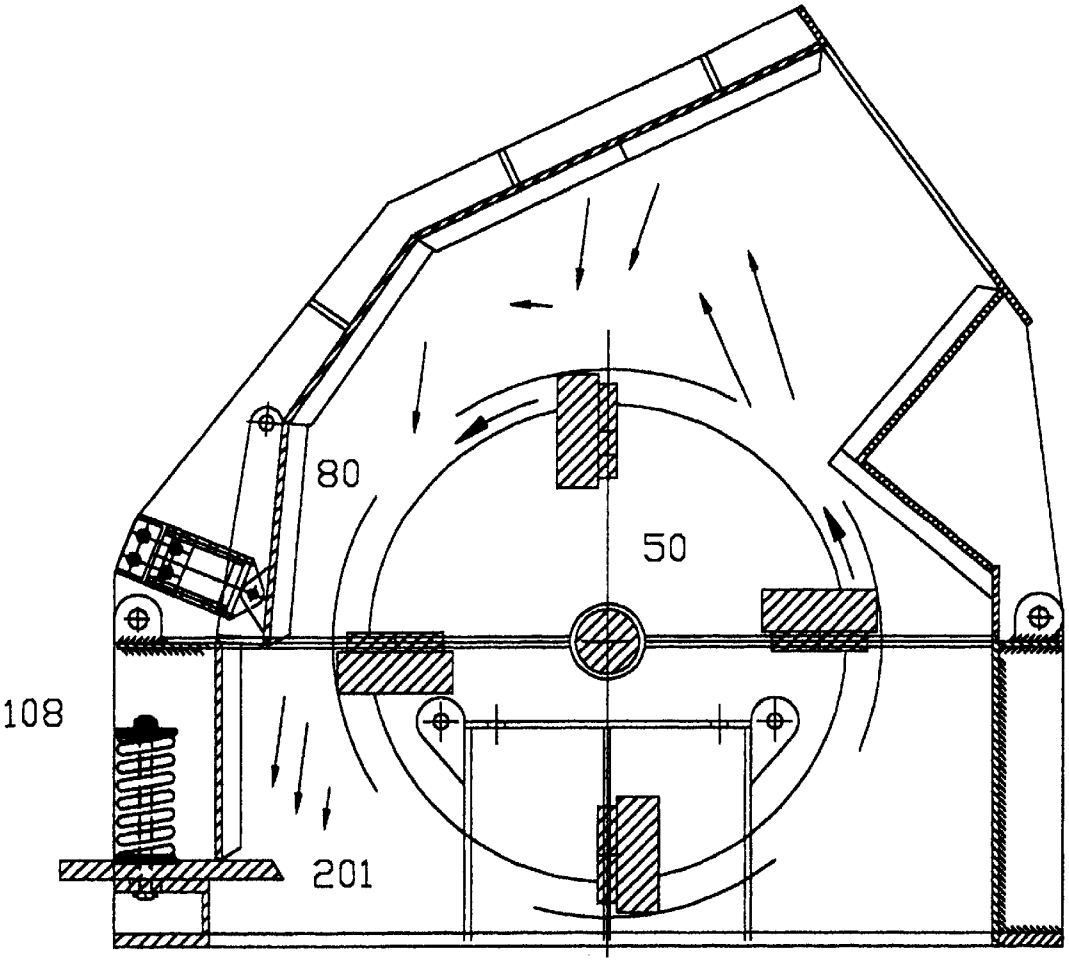
FIG. 6 shows in cut away side view the mineral crusher of FIG. 5, having a returned collection member for collecting and retaining an accumulation of mineral.

Referring to FIG. 6 of the accompanying drawings, there is shown an example of passage of mineral through the crusher under normal operation. Under normal operation the drum 50 rotates in an anti-clockwise direction as seen in FIG. 6, ie in a direction towards the rear of the casing and towards the breaker plates. The impact members 53–56 propel the mineral at the breaker plates lining the roof, and the mineral bounces between the roller and impact members and the breaker plates of the roof, reducing in size by impact with the breaker plates, roller impact members and other pieces of mineral. The adjustable breaker plate 80, in combination with the impact members and roller causes crushing and breaking of the mineral, and from the lower portion of the suspended adjustable upright breaking plate 80, the mineral is propelled and thrown in a general downward direction, where an accumulation of the mineral is collected on the upper surface 102 of the collection member 100, between the collection member and a vertical fixed breaker plate 108 at the rear of the base, to cause a scree type build up 200 of mineral as shown schematically in FIG. 6. The volume of the accumulation may be altered by sliding the collection member further towards the roller, or decreased by retracting the collection member away from the roller. An inclined outer face 201 of the accumulated mineral scree faces the roller. As the mineral is thrown or impelled through the passage between the roller and the rear of casing, the thrown mineral impacts with the accumulation of mineral, causing reduction of the thrown mineral by impacting with the accumulated mineral. Mineral may also be thrown against the substantially vertical breaker plate 108, and the accumulation of material built up between the upper surface of the collection member 100 and the upright or substantially vertical breaker plate 108.

Material running off the accumulated material falls out of the open base of the casing, into a hopper or other receptacle, or into a pile underneath the crusher.

Figure 7:
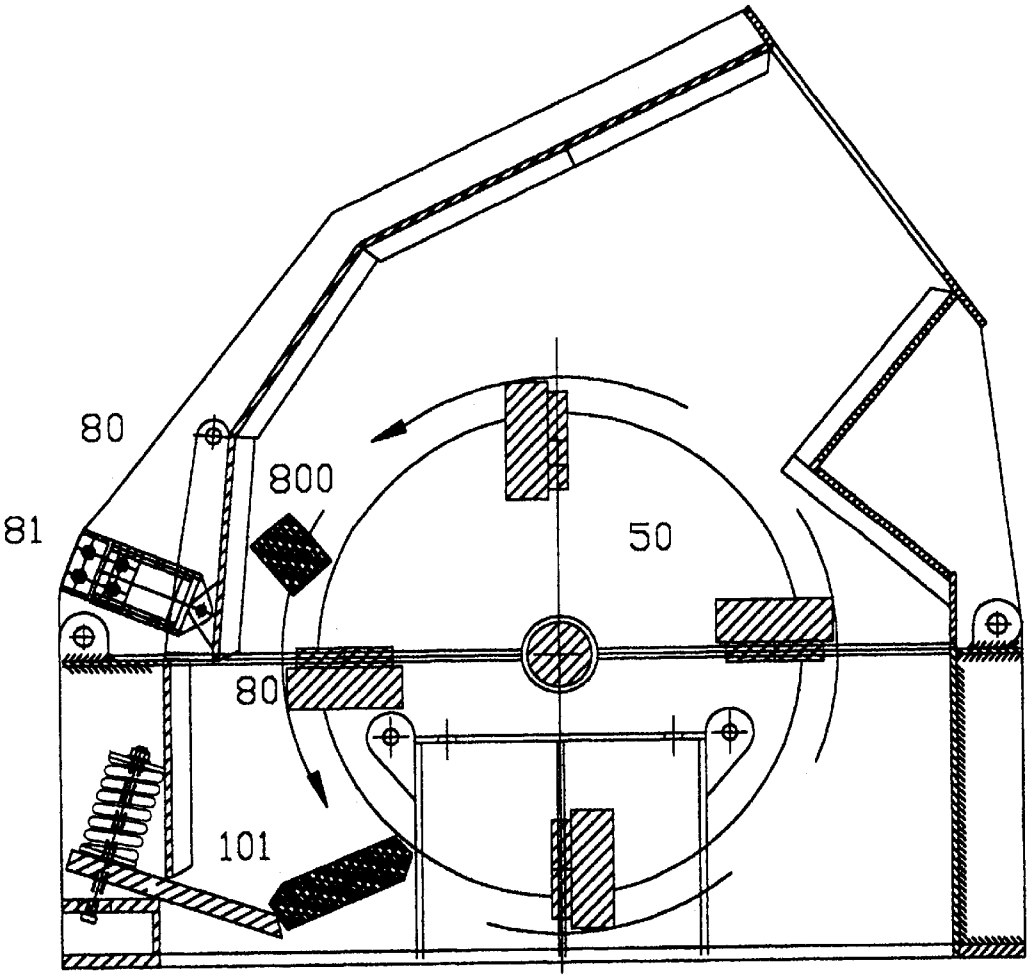
FIG. 7 shows the mineral crusher having the collection member tilted, for example to accommodate passage of an over sized object.

Referring to FIG. 7, herein there will now be described operation of the crusher as an oversize or non-reducible object 800, eg a large piece of steel, a girder or steel bar, or a large block of wood passes through the crusher. A lower end of the adjustable breaker plate 80 swings against the adjustable breaker plate support 81, when the oversize object passes through the gap between the roller and the adjustable breaker plate 80. The springs of the adjustable breaker plate support are pre-selected such as to maintain the breaker plate in the normal operating position as shown in FIG. 5 for forces on the breaker plate caused by normal crushing of material, but to allow some movement of the breaker plate to a release position under extreme forces, such as caused by the passage of an oversized object. Once the oversized object has passed through the gap between the roller and the adjustable breaker plate 80, the lower end of the adjustable breaker plate is immediately returned to the normal operating position by the resilience of the compression coil springs of the adjustable breaker plate support 81.

As the oversize object 800 reaches a position 802 in the passage 101, at which the object must pass between the collection member 100 and the roller 50, the forward end of the collection member 100 tilts as described above, against the compression springs 107 acting on the rear of the collection member. The accumulation of mineral material will be gouged out, or otherwise dislodged by passage of the oversize object 800 past the collection member.

The collection member 100 returns to its substantially horizontal position and continues to collect mineral as previously.

Through successive operation of the mineral crusher, the volume of the accumulation of the material builds up to its previous level or a substantially similar volume, and the crusher may operate as previously, breaking the mineral stream by impact with the accumulation of mineral material.

Figure 8:
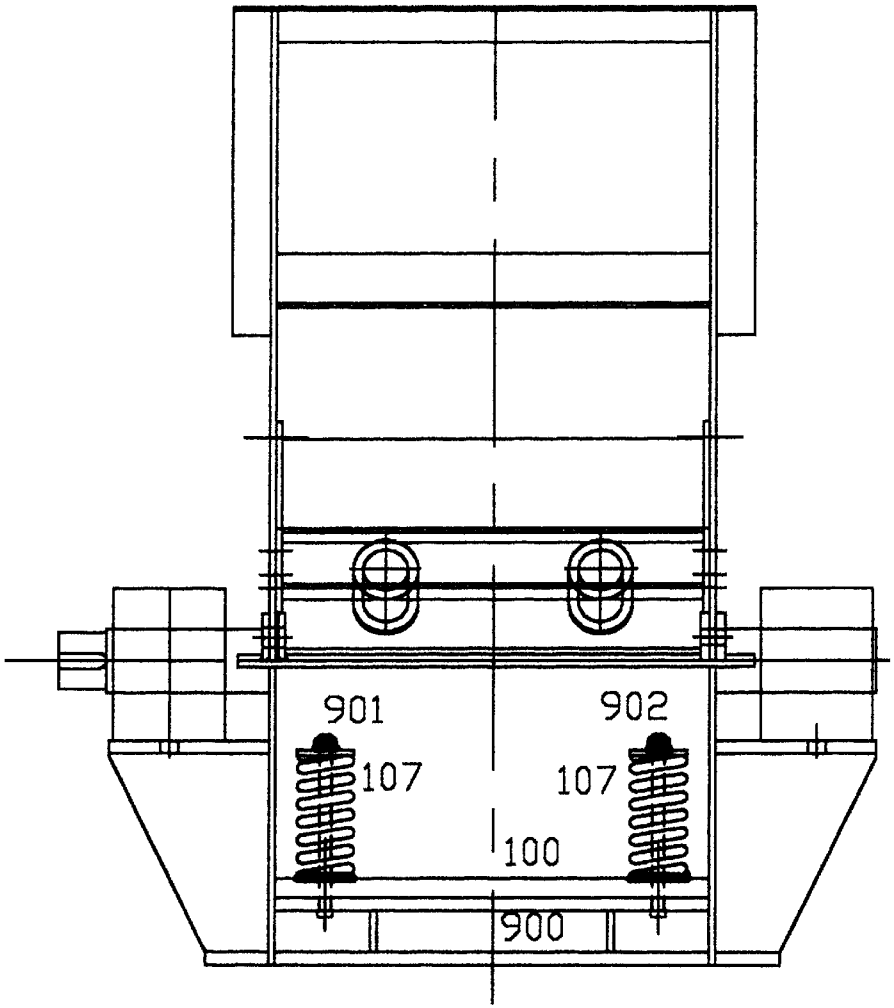
FIG. 8 shows in rear view the mineral crusher.

Referring to FIG. 8 herein, there is shown the mineral crusher in rear view, in which the plurality of compression springs 107 are seen urging a portion of the collection member 100 to a horizontal extending flange 900 of the rear end of the casing base, for keeping the collection member in a substantially horizontal position. First and second elongate bolts 901, 902 secure the compression springs 107 to the flange 900, the bolts passing through the compression springs 107, through apertures in the collection member 100, and being secured to the flange 900.

What is claimed is:

1. A mineral crusher for reducing a mineral material, the mineral crusher comprising:

a rotating roller having a plurality of projecting impact members;

a collection member for retaining an accumulation of mineral material, wherein the arrangement is such that in use, said impact members act to throw the mineral material towards the collection member; and a casing base having an upright wall into which said collection member is removably fitted, characterized by said collection member being retractable and extendible into said upright wall.

2. A mineral crusher as claimed in claim 1, wherein said collection member is tiltable against resilience of at least one compression spring.

3. A mineral crusher as claimed in claim 1, wherein said collection member is tiltable against resilience of at least one compression spring and said tiltable collection member is tiltable about a substantially horizontal position.

4. A mineral crusher as claimed in claim 1, wherein said collection member is tiltable against resilience of at least one compression spring and said tiltable collection member allows passage of oversize material past said collection member.

5. A mineral crusher as claimed in claim 1, wherein said collection member is slideable in a substantially horizontal direction either towards or away from said roller such that a surface area of said collection member extendible from said casing is adjustable.

6. A mineral crusher as claimed in claim 1, wherein said collection member is arranged to accumulate said mineral material such that said accumulation reduces said throwing material upon impact of said throwing material and said accumulated material.

7. A mineral crusher as claimed in claim 1, wherein said collection member comprises an upper surface having an area exposed to said thrown material, said area being adjustable such as to allow the volume of accumulated material to be varied.

* * * * *

UNITED STATES PATENT AND TRADEMARK OFFICE

CERTIFICATE OF CORRECTION

PATENT NO. : 6,070,818
DATED : June 6, 2000
INVENTOR(S) : Taylor

It is certified that error appears in the above-identified patent and that said Letters Patent is hereby corrected as shown below:

Title page,
Item [57] ABSTRACT: "eg" should read -- e.g., --.
Item [73] Assignee: "Taylor Woolhouse Limited" should read -- Taylor Woolhouse Holdings Limited --; per Certificate of Change of Name of April 25, 2000 (pre-issue) filed May 16, 2000.
Item [73] Assignee: "Rotherham," should read -- Rotherham, South Yorkshire, --; per Assignment Documents filed December 22, 1998 and per Issue Fee transmittal form (PTOL-85B) filed March 15, 2000.

Column 6,
Line 45, "slideable" should read -- slidable --.
Column 1,
Lines 46, 48, and 65, "eg." should read -- e.g., --.
Line 65, "non reducible" should read -- non-reducible --.
Line 67, "over size" should read -- oversized --.

Column 2,
Line 4, "semi circular" should read -- semicircular --.
Line 41, "removeably" should read -- removably --.
Line 49, "passed" should read -- past --.
Line 50, "slideable" should read -- slidable --.
Line 52, "roller. Such" should read -- roller such --.

Column 3,
Line 61, "over sized" should read -- oversized --.

Column 4,
Line 26, "eg." should read -- e.g., --
Line 53, "there against," should read -- thereagainst, --.

UNITED STATES PATENT AND TRADEMARK OFFICE

CERTIFICATE OF CORRECTION

PATENT NO. : 6,070,818
DATED : June 6, 2000
INVENTOR(S) : Taylor

It is certified that error appears in the above-identified patent and that said Letters Patent is hereby corrected as shown below:

Column 5,
Line 2, "ie" should read -- i.e., --.
Line 36, "eg" should read -- e.g., --.

Signed and Sealed this

Twenty-fifth Day of December, 2001

*Attest:*

*Attesting Officer*

JAMES E. ROGAN
*Director of the United States Patent and Trademark Office*